US005604326A

United States Patent [19]

Lescure

[11] Patent Number: 5,604,326

[45] Date of Patent: Feb. 18, 1997

[54] STRIKER DEVICE FOR A FIREARM

[75] Inventor: Jean-Francois Lescure, Bourges, France

[73] Assignee: Giat Industries, Versailles, France

[21] Appl. No.: 360,449

[22] Filed: Dec. 21, 1994

[30] Foreign Application Priority Data

Dec. 21, 1993 [FR] France ..... 93 15374

[51] Int. Cl.[6] ..... F41A 3/74; F41A 19/13

[52] U.S. Cl. ..... 89/26; 89/17; 89/27.14; 42/69.03

[58] Field of Search ..... 89/26, 19, 20.2, 89/20.4, 21, 17, 27.14, 27.13; 42/69.03

[56] References Cited

U.S. PATENT DOCUMENTS

| | | | |
|---|---|---|---|
| 45,586 | 12/1864 | Cleu | 89/26 |
| 800,663 | 10/1905 | Meigs et al. | 89/27.13 |
| 1,359,045 | 11/1920 | Fisher | 89/21 |
| 2,099,035 | 11/1937 | Rowley et al. | 42/16 |
| 3,547,001 | 12/1970 | Stoner | 89/17 |
| 3,728,938 | 4/1973 | Scibor et al. | 89/26 |

FOREIGN PATENT DOCUMENTS

| | | | |
|---|---|---|---|
| 2-678-057 | 12/1992 | France . | |
| 298815 | 5/1916 | Germany . | |
| 525152 | 4/1931 | Germany . | |
| 62223 | 6/1924 | Sweden | 89/17 |
| 48609 | 6/1909 | Switzerland . | |

*Primary Examiner*—Stephen M. Johnson
*Attorney, Agent, or Firm*—Oliff & Berridge

[57] ABSTRACT

A striker device for a firearm of the type having a loading chamber for a munition includes a detonator cap provided with a percussion cap and a translationally movable assembly comprised of a striker equipped with a striker tip and associated with a part or valve in which the striker is axially guided and that is itself guided in axial displacement in a passage of a striker body located to the rear of the loading chamber. The striker and valve are respectively mounted by the front and rear faces of striker body and joined to each other by a removable connector of the bayonet type.

12 Claims, 2 Drawing Sheets

STRIKER DEVICE FOR A FIREARM

BACKGROUND OF THE INVENTION

The invention relates to a striker device for a firearm of the type having a loading chamber for a munition whose detonator cap is provided with a percussion cap. The device includes a translationally movable assembly comprised of a striker equipped with a striker tip and associated with a part or valve in which the striker is axially guided and which is itself guided in axial displacement in a passage of a striker body located to the rear of the loading chamber and which has, on one face or front face, a firing pocket against which the detonator cap of the munition is normally applied, and structure for moving the striker between a cocked position in which its striker tip is withdrawn inside the passage of the striker body and a firing position in which its striker tip projects into the firing pocket of the striker body to strike the percussion cap.

A striker device of the aforementioned type is described in particular in Applicant's French patent FR-A2 678 057.

In general, the striker device described in this prior document is equipped with structure allowing for compensation of the relatively large lengthwise play that may exist in the chamber of the weapon between the firing pocket and the munition detonator cap, for example due to the accumulation of dimensional tolerances, and to a differential in thermal expansion and increased humidity when the cases of the munitions are made of nonmetal materials. The play between the firing pocket and the munition detonator cap may when be greater than the projection of the striker tip into the firing pocket, and the munition does not ignite.

However, a striker device is relatively complex because of the large number of parts that must be assembled. As a result, the machining and assembly operations are delicate and must be carried out by skilled personnel.

SUMMARY OF THE INVENTION

A goal of the invention is to design a striker device that has a simplified structure limiting machining operations, facilitating assembly operations, and guaranteeing elimination of the play that may exist between the firing pocket and the munition detonator cap upon operation.

For this purpose, the invention offers a striker device of the aforementioned type wherein the striker and valve that form the movable assembly of the striker device are supported respectively by the front and rear faces of the striker body and are joined to each other by a removable connector of the bayonet type.

BRIEF DESCRIPTION OF THE DRAWINGS

Other advantages, characteristics, and details of the invention will emerge from the explanatory description provided with reference to the attached drawings, given solely as examples, wherein.

DETAILED DESCRIPTION OF PREFERRED EMBODIMENTS

Figure 1:
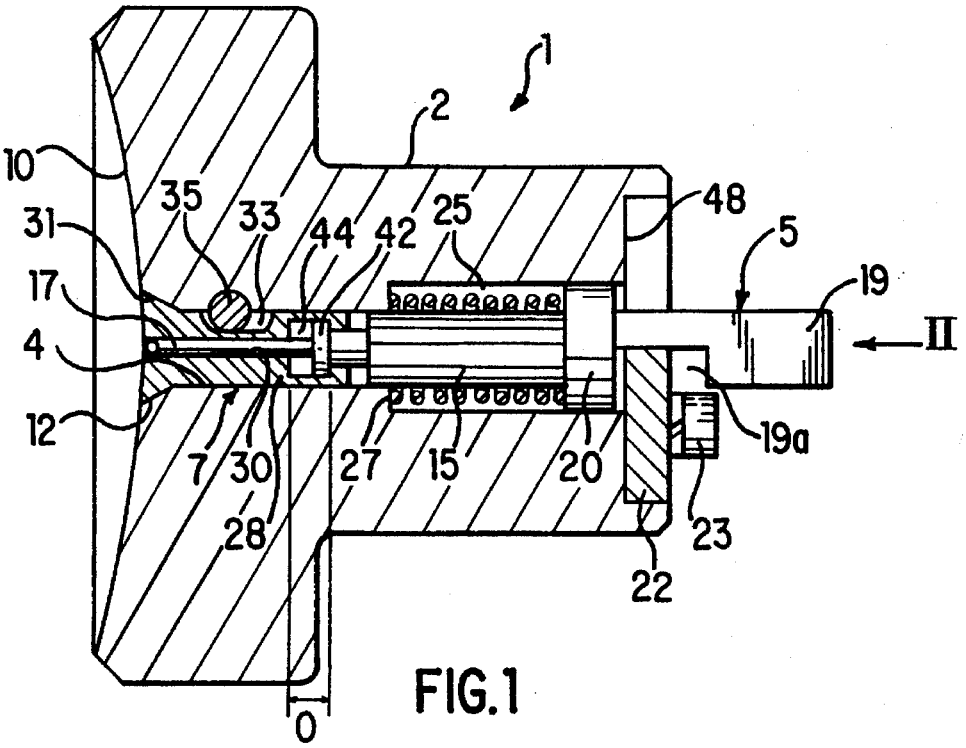
FIG. 1 is a partial lengthwise section of a striker device according to the invention shown in the cocked position.

In general, the striker has a body extended axially on one side by the striker tip and on the other side by a tail that cooperates with a striker displacement device; the valve has a body containing a passage for free movement of the striker tip, and, according to another characteristic of the invention, the removable connector between the striker and the valve has a first assembly element with an oval cross section supported by the striker tip and located in the vicinity of the striker body, and a second assembly element constituted by a recess machined into the body of the valve and which, on the rear face of the valve opposite the striker, terminates in an opening forming a "buttonhole" with a shape matching that of the first assembly element to engage this first assembly element inside the recess, which latter element is oriented at essentially 90° relative to its assembly position with the valve, which assembly position is then obtained by pivoting the striker through an angle of 90°.

According to another characteristic of the invention, the first assembly element is thinner than the axial length of the recess forming the second assembly element and is located at a sufficient distance from the striker body to achieve relative displacement of the striker relative to the valve and to allow the striker tip to project forward of the valve when the striker is in the firing position.

According to one embodiment, the first assembly element is constituted by a collar onto which two flats are machined opposite each other.

According to another characteristic of the invention, the striker device also has a first device for immobilizing the valve rotationally once the valve is mounted in the passage of the striker body, while allowing axial displacement of the valve to enable it to project into the firing pocket.

According to one embodiment, the first immobilization device is constituted by a flat machined in the body of the valve and by a retaining pin designed to engage this flat.

According to another characteristic of the invention, the striker device has a second device for immobilizing the striker rotationally, once the latter is joined to the valve, while allowing axial displacement of the striker to allow the striker tip to project at the front face of the valve.

According to one embodiment, the second immobilization device comprises a plate attached to the rear face of the striker body beyond which the tail of the striker projects, which plate engages, on one side, a notch in the tail of the striker which has a polygonal cross section, square for example, the notch extending axially over a length greater than the thickness of the retaining plate.

Thus, the two aforesaid devices for immobilizing the valve and striker rotationally hold these two elements in the assembled position when the striker device moves between its cocked position and its firing position.

According to another characteristic of the invention, a return spring is mounted around the striker body, which spring at one end abuts a shoulder provided in the passage in the striker body and at the other end abuts one face of a boss provided on the striker body, and which is designed to return the striker device automatically to the cocked position.

Thus, when the striker displacement device is activated, the striker moves alone in the direction of the firing pocket as long as the rear face of its body is not in contact with the rear face of the valve. During this displacement, the striker tip projects at the front face of the valve. Then the movable striker-valve assembly moves in the direction of the detonator cap of the munition, at which point the valve projects in the firing pocket to contact the detonator cap of the munition and cause the striker to strike the percussion cap.

In general, the operational reliability of a striker device is particularly linked to the presence of the projection of the striker tip at the front face of the valve, which requires precise dimensioning of certain parts.

Also, according to one important advantage of the invention, to ensure the projection of the striker tip at the front face of the valve, only two dimensions must be respected, namely: the dimension of the striker tip when the striker body comes in contact with the rear face of the valve as it moves into its firing position, and the dimension of the valve between its front face and its rear face.

According to another important advantage of the invention, the mounting and assembly of the valve and striker in the striker body are accomplished very simply without requiring preassembly of parts before mounting in the striker body.

According to another advantage of the invention, the simplicity of the striker device mounting and disassembly operations facilitates maintenance, particularly when the striker device must be replaced.

According to another advantage of the invention, the simplicity of the striker device enables its operating status to be rapidly checked and a machining error to be detected.

According to yet another advantage of the invention, the striker device is composed of a small number of parts, which are simple and inexpensive to manufacture.

Striker device 1 as shown in FIG. 1 according to one embodiment of the invention has a fixed striker body 2 with a central passage 4 in which a translationally movable assembly is mounted.

The movable assembly is composed of a striker 5 associated with a part called a valve 7 in which it is axially guided and which is itself guided in axial displacement in passage 4 of striker body 2.

Striker body 2 has a front end whose front face is slightly concave and delimits a firing pocket 10. Passage 4 terminates in the center part of pocket 10 with a widened end 12 having a frustoconical shape machined in body 2.

Figure 2:
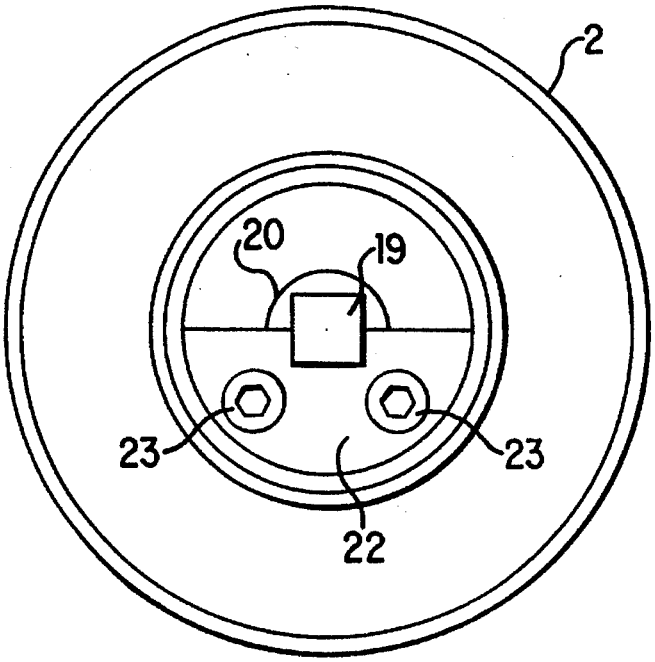
FIG. 2 is an endwise view along arrow II in FIG. 1.

Striker 5 is composed of a body 15, cylindrical for example, one end of which extends axially on one side by a striker tip 17 and the other, opposite end, extends by a tail 19 with interposition of a cylindrical boss 20 with a greater diameter than that of body 15. Tail 19 of striker 5 has a polygonal cross section, square for example, and has a square notch **19*a* adjacent boss 20 in body 15. This notch 19*a* is designed to cooperate with a plate 22 immobilizing striker 5 rotationally. More specifically, plate 22 (FIG. 2) is in the form of a half-disk whose straight side is designed to engage notch 19*a* of tail 19 of striker 5. Plate 22 is designed to be joined to the rear face of valve 7 and be attached thereto by screws 23. The axial length of notch 19*a* of tail 19 is greater than the thickness of plate 22 to allow striker 5** to move axially.

A return spring 25 is designed to be mounted around body 15 of striker 5 and abut one face of boss 20 and a shoulder 27 provided in passage 4 of striker body 2.

Valve 7 is composed of a cylindrical body 28 of the same diameter as body 15 of striker 5. This body 28 is traversed by a central passage 30 in which striker tip 17 is designed to engage freely, and has a widened front end 31 that is frustoconical in shape. Widened front ends 12 and 31 of passage 4 and body 28 have frustoconical shapes that substantially match each other. A flat 33 is machined on the periphery of body 28 and is designed to receive a pin 35 to immobilize valve 7 rotationally while allowing the valve to move axially over a predetermined length.

Figure 3:
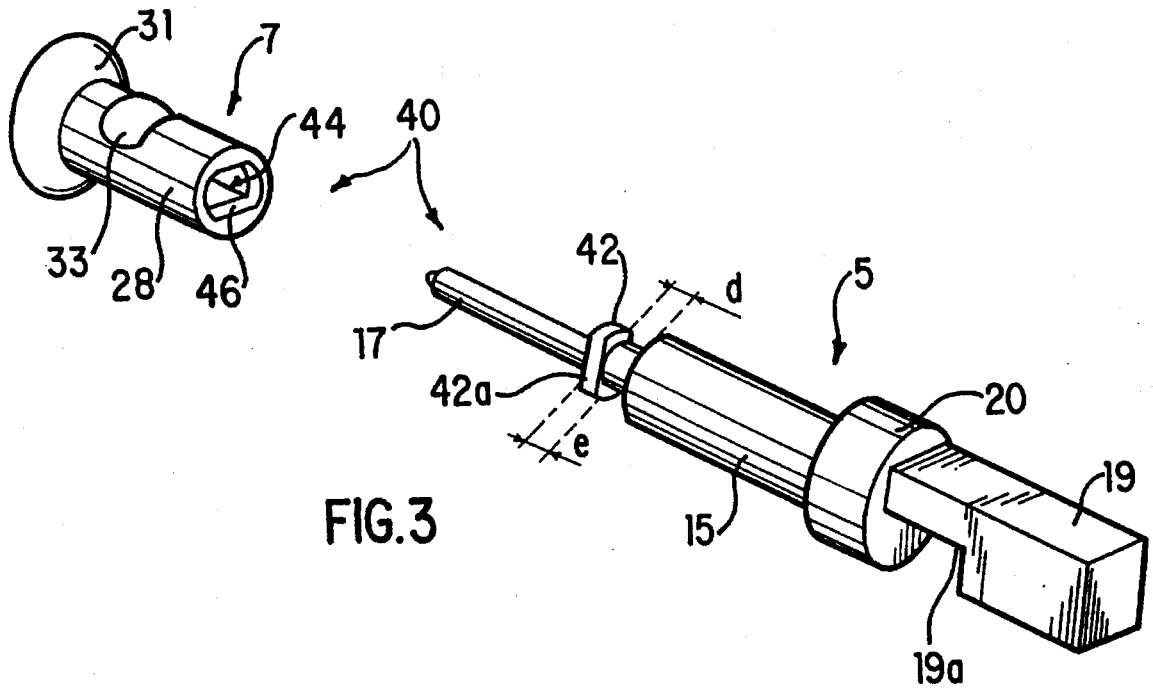
FIG. 3 is an exploded perspective view of the movable striker device assembly.

Joining of striker 5 and valve 7 is accomplished with the aid of a removable connector 40 of the bayonet type illustrated in FIG. 3. This connector 40 has a first assembly element comprised of a collar 42 integral with striker tip 17, and a second assembly element composed of a recess 44 machined at the rear part of valve 7.

Collar 42 is located in the vicinity of body 15 of striker 5 and is a distance d therefrom. Two flats **42*a* opposite each other are machined on collar 42** to confer an essentially oval shape thereon.

Recess 44, which communicates with passage 30 of valve 7, terminates at the rear face of valve 7 by an opening 46 forming a "buttonhole." This opening 46 has a shape matching that of collar 42 and is dimensioned to allow the collar, appropriately preoriented, to engage freely in recess 44 before causing the striker to pivot 90° relative to valve 7 to obtain the assembly position wherein collar 42 is held inside recess 44. Recess 44 extends axially over a length D greater than the thickness e of collar 42 to allow relative displacement of striker 5 relative to valve 7.

Figure 4:
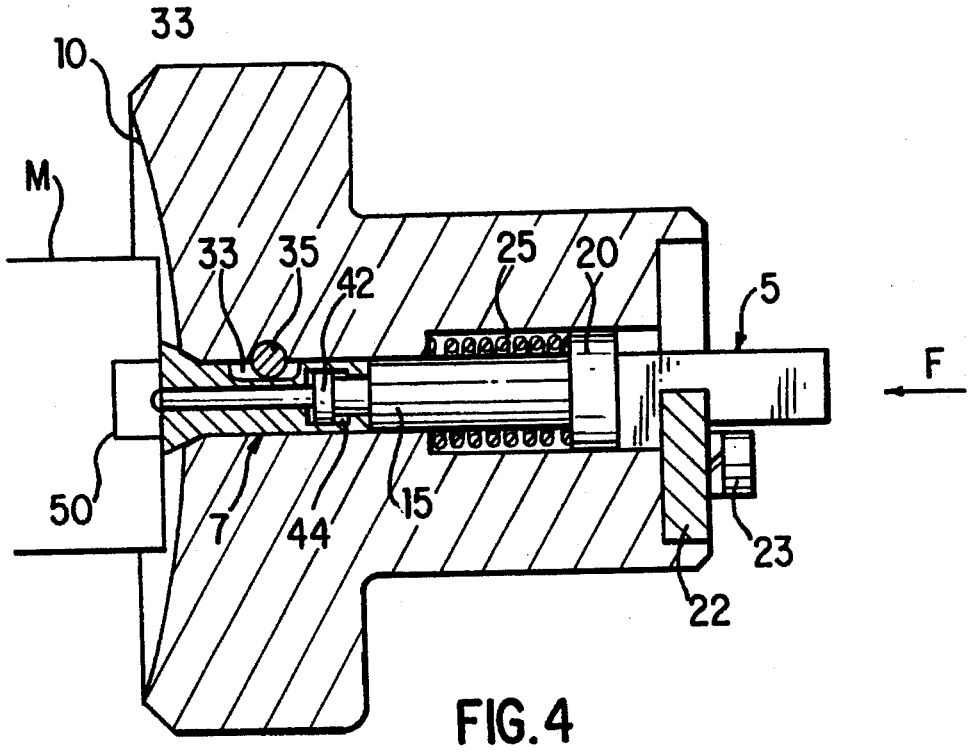
FIG. 4 is a partial lengthwise sectional view similar to that of FIG. 1 but with the striker device shown in the firing position.

In general, striker body 2 is designed to be mounted in the lock of a firearm to close the loading chamber containing a munition M to be fired (FIG. 4). The detonator cap of munition M is provided with a percussion cap 50, and when the munition is loaded into the chamber, the detonator cap normally rests against firing pocket 10 of body 2 whose passage 4 is substantially axially aligned with percussion cap 50.

The principle by which striker 5 and valve 7 are mounted and assembled in striker body 2 will now be described.

Valve 7 is mounted in the front face of striker body 2. More specifically, the rear part of valve 7 is engaged in the end of passage 4, which terminates in firing pocket 10. Pin 35 then engages flat 33 of valve 7 to immobilize it rotationally.

Striker 5 is mounted at the rear of striker body 2. More specifically, return spring 25 is placed around body 15 of striker 5 before striker tip 17 is engaged in passage 4 of body 2, then in passage 30 of valve 7. When it is introduced, striker 5 must be oriented such that its collar 42 can penetrate recess 44 of valve 7.

Retaining plate 22 is then positioned against the rear face of valve 7 so that it engages notch **19*a* of tail 19 of striker 5. Plate 22 is advantageously received in a cavity 48 provided in the rear face of striker body 2. Finally, the assembly formed by striker 5 and plate 22 is pivoted 90° to ensure assembly of striker 5 and valve 7 by trapping collar 42 in recess 44 of valve 7, and plate 22 is attached to striker body 2 by screws 23 to immobilize striker 5 rotationally and maintain its integrity with valve 7**.

Striker device 1 is thus in the cocked position shown in FIG. 1 wherein:

- frustoconical front part 31 of valve 7 is in contact with front frustoconical part 12 of passage 30 so that the forward end of valve 7 is flush with firing pocket 10 of striker body 2,
- collar 42 of striker 5 is supported by the rear face of recess 44,
- the rear face of center boss 20 of the striker is not in contact with plate 22 that immobilizes striker 5 rotationally, and pin 35 is not in contact with the front end of flat 33 of valve 7 to produce the flush alignment of the front face of valve 7 and firing pocket 10, return spring 25 is slightly stretched, the front face of body 15 of striker 5 is located at a distance from the rear face of valve 7, and striker tip 17 is withdrawn inside passage 30 of valve 7.

Due to the action of a displacement device (not shown), which acts on the rear end of tail 19 of striker 5, according to arrow F in FIG. 4, striker 5 moves axially in the direction of firing pocket 10. In the first phase, striker 5 moves alone with simultaneous compression of return spring 25, whereby striker tip 17 gradually emerges at the front face of valve 7. In a second phase, when the front face of body 15 of striker 5 comes to rest against the rear face of valve 7, the valve 7 is displaced axially, gradually emerging on firing pocket 10. The movable assembly composed of striker 5 and valve 7 moves simultaneously until the front face of the valve comes in contact with the detonator cap of munition M to allow percussion cap 50 to be struck by tip 17.

As soon as the activation device (F) is no longer applied to tail 19 of striker 5, return spring 25 returns striker device 1 to its cocked position shown in FIG. 1.

While the embodiments described herein are preferred, it will be appreciated from the specification that various alternatives, modifications, variations or improvements therein may be made by those skilled in the art that are within the scope of the invention, which is defined by the following claims.

What is claimed is:

1. A striker device for a firearm of the type having a loading chamber for a munition provided with a percussion cap, the striker device comprising:

a translationally movable assembly including a striker having a striker tip, said striker being engageable with a valve in which the striker is axially guided, said valve being guided in axial displacement in a passage of an assembly body disposed adjacent the loading chamber, the assembly body having a firing pocket at the percussion cap; and means for moving the striker and valve between a cocked position in which the striker tip is withdrawn inside the passage of the assembly body and a front face of the valve is flush with a surface of the firing pocket, and a firing position in which both the striker tip and the valve move into the firing pocket, wherein said striker and said valve are respectively mounted on opposite sides of the assembly body and joined to each other by a removable connector.

2. The striker device according to claim 1, wherein the striker has a body extending axially on one side by the striker tip and on the other side by a tail cooperating with the moving means and wherein the valve has a body containing a passage for free movement of the striker tip, said removable connector having a first assembly element supported by the striker tip and located in the vicinity of the striker body, and a second assembly element constituted by a recess machined into the valve body forming a buttonhole with a shape matching a shape of the first assembly element to engage the first assembly element inside the recess.

3. The striker device according to claim 2, wherein the first assembly element has a thickness (e) less than an axial length of the recess.

4. The striker device according to claim 2, wherein the first assembly element comprises a collar onto which two flats are machined opposite each other.

5. The striker device according to claim 1, further comprising a first device for immobilizing the valve rotationally once the valve is mounted in the passage of the assembly body, said first device allowing axial displacement of the valve to enable it to project toward the percussion cap.

6. The striker device according to claim 5, wherein the first device comprises a flat and machined in the body of the valve and a retaining pin designed to engage the flat.

7. A percussion device according to claim 1, further comprising a second device for immobilizing the striker rotationally, once the striker is joined to the valve, said second device allowing axial displacement of the striker to allow the striker tip to project at the front face of the valve.

8. The striker device according to claim 7, wherein the second device comprises a plate attached to a rear face of the assembly body beyond which a tail of the striker projects, said plate being engageable with a notch in the tail of the striker, said notch extending axially over a length greater than the thickness of the plate.

9. The striker device according to claim 1, wherein a return spring is mounted around a body of the striker, said return spring at one end abutting a shoulder provided in the passage in the assembly body and at the other end abutting one face of a boss provided on the striker body.

10. A striker device for a firearm of the type having a loading chamber for a munition provided with a percussion cap, the striker device comprising:

an assembly body having a firing pocket adjacent said percussion cap, said assembly body including a passage therein;

a striker having a striker tip, said striker being disposed in said passage;

a valve engageable with said striker in said passage, said striker being axially movable relative to said valve, wherein said striker engaged with said valve forms a translationally movable assembly in said passage, said translationally movable assembly is movable between a cocked position in which the striker tip is withdrawn inside the passage of the assembly body and a front face of the valve is flush with a surface of the firing pocket, and a firing position in which both the striker tip and the valve move into the firing pocket; and a removable connector connecting said striker and said valve in said passage.

11. The striker device according to claim 10, wherein said removable connector comprises:

a first assembly element supported by the striker tip and having a non-circular shape; and a second assembly element comprising a recess in said valve, said recess having a shape matching said first assembly element.

12. The striker device according to claim 11, wherein said recess has an axial length greater than a thickness of said first assembly element enabling movement of said first assembly element in said recess.

* * * * *